US005797385A

United States Patent [19]

Thai

[11] Patent Number: 5,797,385

[45] Date of Patent: Aug. 25, 1998

[54] DOUBLE-BARREL TOY GUN

[75] Inventor: Douglas Thai, Hong Kong, Hong Kong

[73] Assignee: Placo Toys International, Ltd., Hong Kong, Hong Kong

[21] Appl. No.: 827,351

[22] Filed: Mar. 26, 1997

[51] Int. Cl.[6] ..... F41B 11/14

[52] U.S. Cl. ..... 124/66; 124/59

[58] Field of Search ..... 124/56, 59, 66, 124/67

[56] References Cited

U.S. PATENT DOCUMENTS

| | | |
|---|---|---|
| 1,575,644 | 3/1926 | Schmidt . |
| 2,237,678 | 4/1941 | Lohr et al. . |
| 2,888,004 | 5/1959 | Steiner . |
| 3,139,700 | 7/1964 | Wyrick . |
| 5,186,156 | 2/1993 | Clayton . |
| 5,323,755 | 6/1994 | Hsieh . |
| 5,359,985 | 11/1994 | Schumacher . |

*Primary Examiner*—John A. Ricci
*Attorney, Agent, or Firm*—Raymond Sun

[57] ABSTRACT

A toy gun is disclosed as having a trigger with opposing first and second ends. First and second barrels are provided, each holding at least one ammunition. The toy gun further includes a first housing adjacent the first end of the trigger and coupled to the first barrel, the first housing having a firing mechanism coupled to the trigger for firing the ammunition from the first barrel. The toy gun also includes a second housing adjacent the second end of the trigger and coupled to the second barrel, the second housing having a firing mechanism coupled to the trigger for firing the ammunition from the second barrel. The toy gun may be operated such that one ammunition at each of the first and second barrels are fired simultaneously upon actuation of the trigger. Alternatively, one ammunition at the first barrel may be fired without firing any ammunition at the second barrel, upon actuation of the trigger.

19 Claims, 5 Drawing Sheets

DOUBLE-BARREL TOY GUN

BACKGROUND OF THE INVENTION

1. Field of the Invention

The present invention relates to toy guns, and in particular, to a double-barrel toy gun having a hand shield and the ability to fire ammunition from both barrels at the same time, or selectively from one barrel and not from the other barrel.

2. Description of the Prior Art

Toy guns have been provided for the entertainment of children for a long time. Most of these prior art toy guns have a single barrel for firing soft ammunition, such as foam bullets or darts, that are safe for use by children. Unfortunately, children demand variety in their play things, and many children have grown tired of single-barrel toy guns. Many children are now demanding toys, and in particular, toy guns, that are different and which offer more excitement, sophistication and options.

In addition, to meet the demand for more exciting and sophisticated toys, the construction of many toys have unfortunately become more complex and therefore more expensive.

SUMMARY OF THE DISCLOSURE

It is an object of the present invention to provide a toy gun that offers more exciting play than the pre-existing single-barrel toy guns, but which has a simple construction.

It is another object of the present invention to provide a toy gun that has two barrels for firing ammunition.

It is yet another object of the present invention to provide a toy gun with one trigger mechanism that controls the firing options for two barrels.

It is a further object of the present invention to provide a double-barrel toy gun which allows ammunition to be fired simultaneously from both barrels.

It is yet a further object of the present invention to provide a double-barrel toy gun which allows ammunition to be fired selectively from one but not both of the barrels.

In order to accomplish the objects of the present invention, there is provided a toy gun that includes a handle section having a trigger with opposing first and second ends. First and second barrels are provided, each holding at least one ammunition. The toy gun further includes a first housing adjacent the first end of the trigger and coupled to the first barrel, the first housing having a firing mechanism coupled to the trigger for firing the ammunition from the first barrel. The toy gun also includes a second housing adjacent the second end of the trigger and coupled to the second barrel, the second housing having a firing mechanism coupled to the trigger for firing the ammunition from the second barrel. The toy gun optionally includes a shield connected to the first and second housings and covering the handle section.

According to one embodiment of the present invention, the firing mechanism in both housings has a piston assembly for delivering air pressure to the respective barrel for firing the respective ammunition. The trigger includes a first section having a first latch assembly coupled to the piston assembly in the first housing for actuating the piston assembly, and a second section having a second latch assembly coupled to the piston assembly in the second housing for actuating the piston assembly. The trigger further includes a first leg at the first section for engaging the first barrel, and a second leg at the second section for engaging the second barrel. Each barrel includes a stem coupled to the respective housing, the stem having a plurality of scalloped regions, with one of the legs received in one of the plurality of scalloped regions. Each scalloped region has a straight edge coupled to a ramped edge. A barrel shaft is received inside the stem and includes a plurality of protrusions, each protrusion positioned within the confines of and below a scalloped region, and each protrusion having an angled edge. Each barrel further includes a plurality of tubes for holding ammunition, with one of the tubes in communication with one of the piston assemblies for receiving air pressure to fire the ammunition held at that tube.

The toy gun according to the present embodiment may be fired by pressing on the gripping section of the trigger, which causes the latch members to reciprocate the piston assembly to fire the ammunition. After releasing the trigger, spring-loaded mechanisms provided in each housing will bias the trigger away from actuating the piston assembly. During actuation of the trigger, each leg positioned in a scalloped region slides rearwardly along the straight edge of one scalloped region and the angled edge of its corresponding protrusion to rotate the barrel, and when the trigger is released, each leg is then received into the adjacent scalloped region and slides forwardly along the ramped edge of the adjacent scalloped region to further rotate the barrel.

The toy gun according to the present invention may be operated such that one ammunition at each of the first and second barrels are fired simultaneously upon actuation of the trigger. This can be accomplished by applying a substantially equal force to both the first and second ends of the trigger. Alternatively, one ammunition at the first barrel may be fired without firing any ammunition at the second barrel, upon actuation of the trigger. This may be accomplished by applying a greater force to the first end of the trigger than to the second end of the trigger.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
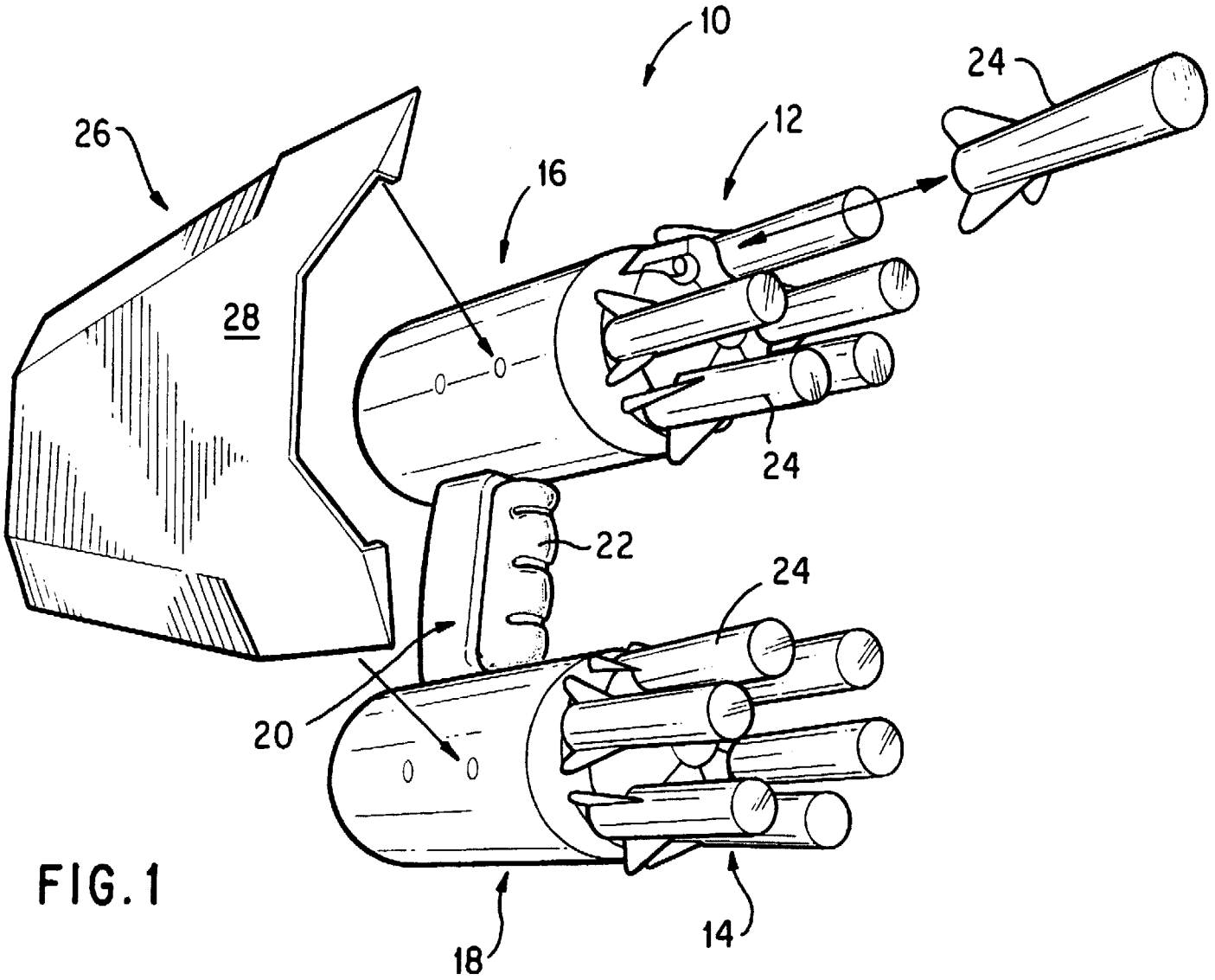
FIG. 1 is an exploded perspective view of a toy gun according to the present invention.

Referring to FIG. 1, the toy gun 10 has two revolving barrels 12 and 14, each supported by a cylindrical housing 16 and 18, respectively. A handle and trigger section 20 bridges or connects the cylindrical housings 16 and 18, and has a trigger 22 that controls the firing action of both barrels 12 and 14. Each barrel 12 and 14 is adapted to hold and fire a plurality of foam darts or arrows 24. A hand shield 26 is optionally connected to both cylindrical housings 16 and 18, and is configured with a hump or raised section 28 to allow a user's hand to fit underneath the raised section 28 to grip the handle and trigger section 20. The connection between the shield 26 and the housings 16 and 18 may be removable to allow the user to use the toy gun 10 with or without the shield 26. The shield 26 adds to the overall play value of the toy gun 10 by shielding the hand of the user, and by giving the toy gun 10 a more sophisticated appearance.

Figure 2:
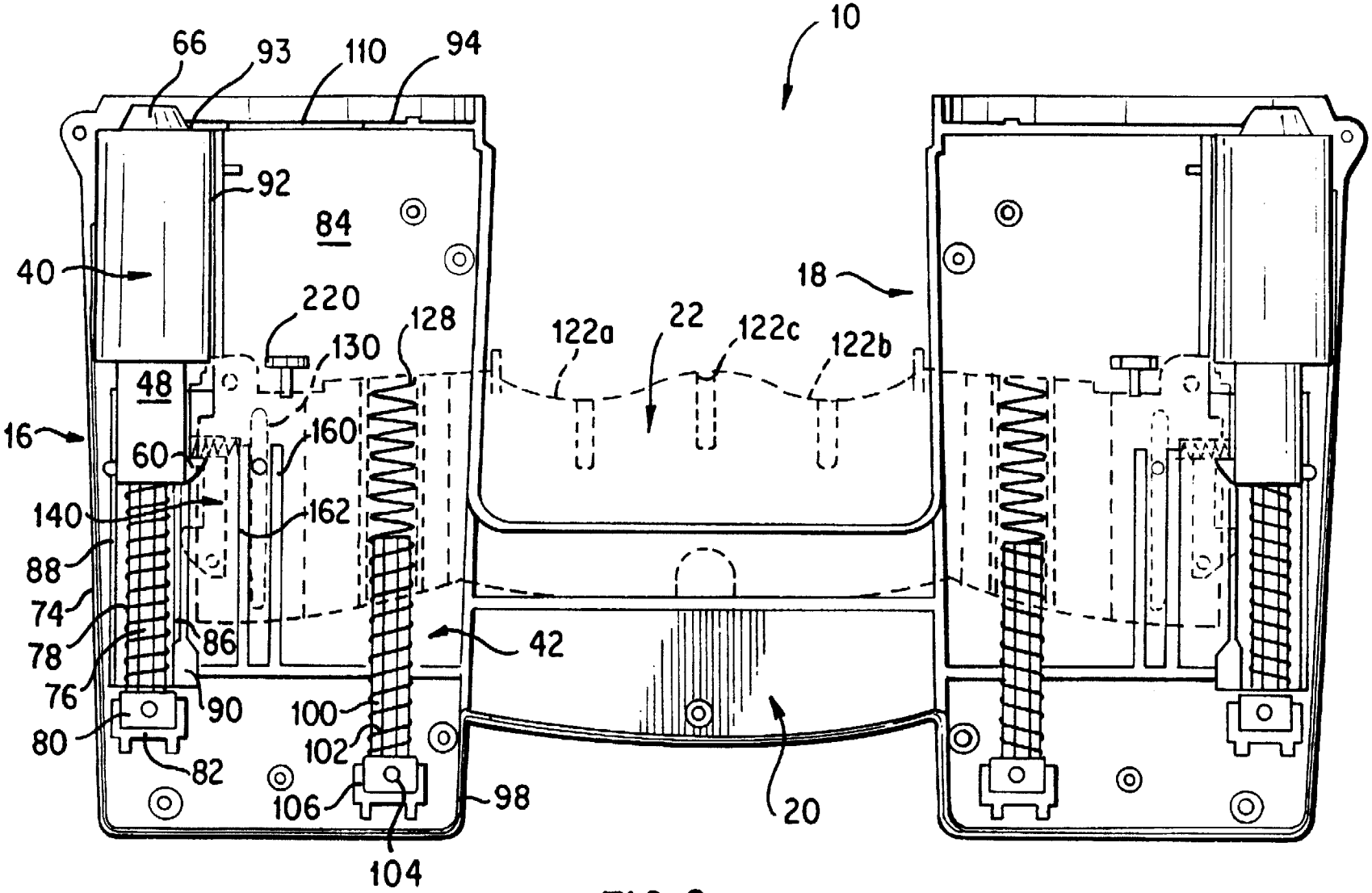
FIG. 2 is a cross-sectional top plan view of a lower half of the toy gun of FIG. 1.

The toy gun 10 has an upper half or shell and a lower half or shell that are combined together to form the toy gun 10. The lower half of the toy gun 10 and the portions of its cylindrical housings 16 and 18 are illustrated in FIG. 2. The upper half of the housings 16 and 18 includes the same elements as the lower half, except that the raised support wells 82 and 106, and the stop member 90, of each housing 16 and 18 (described below) are omitted. The upper and lower halves of the toy gun 10 are connected together by means of screws, glue, rivets, fasteners and other conventional connecting mechanisms.

Figure 3:
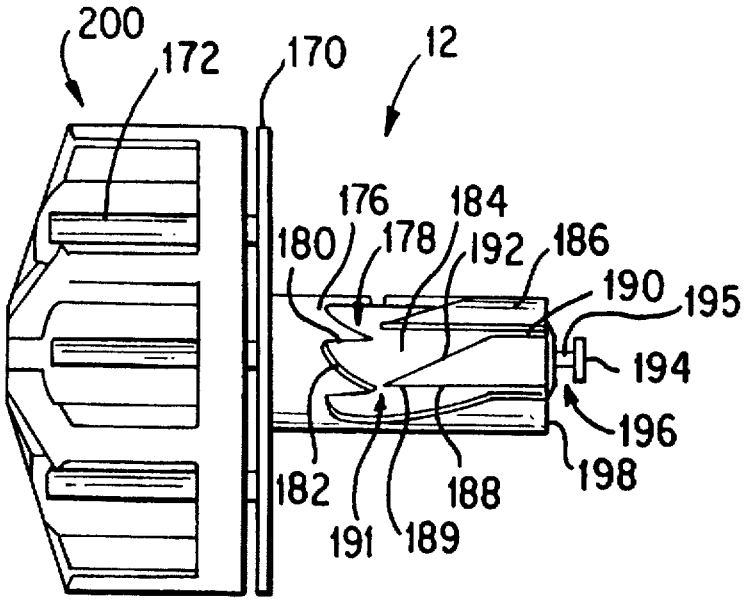
FIG. 3 is a side plan view of a barrel of the toy gun of FIG. 1.
Figure 4:
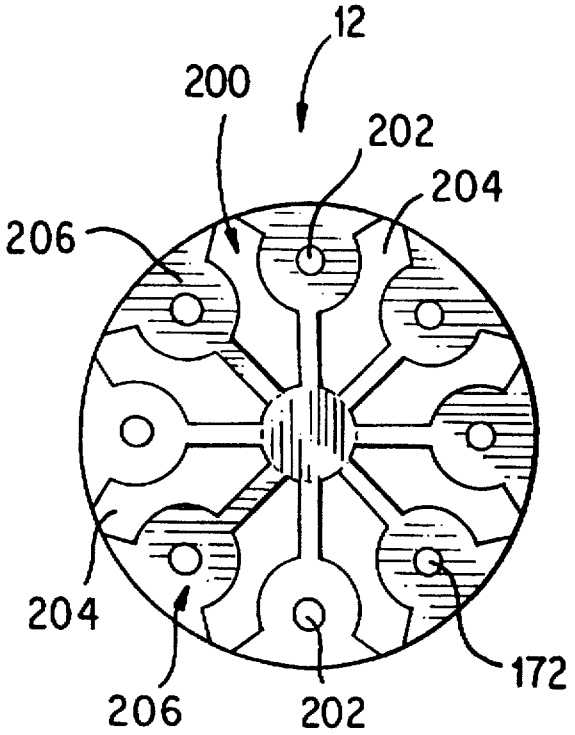
FIG. 4 is a front plan view of the barrel of FIG. 3.
Figure 5:
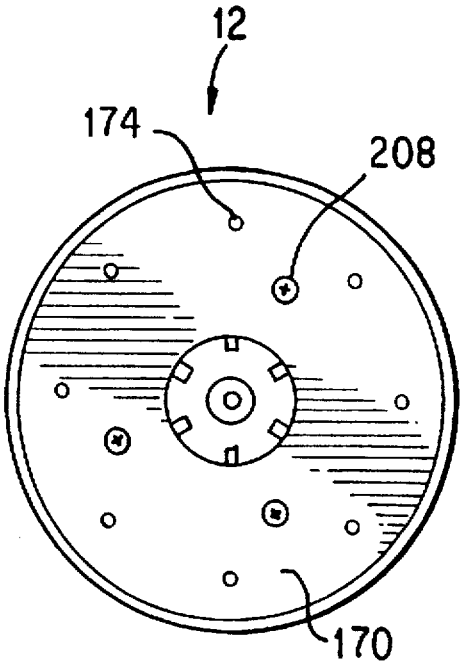
FIG. 5 is a rear plan view of the barrel of FIG. 3.
Figure 6:
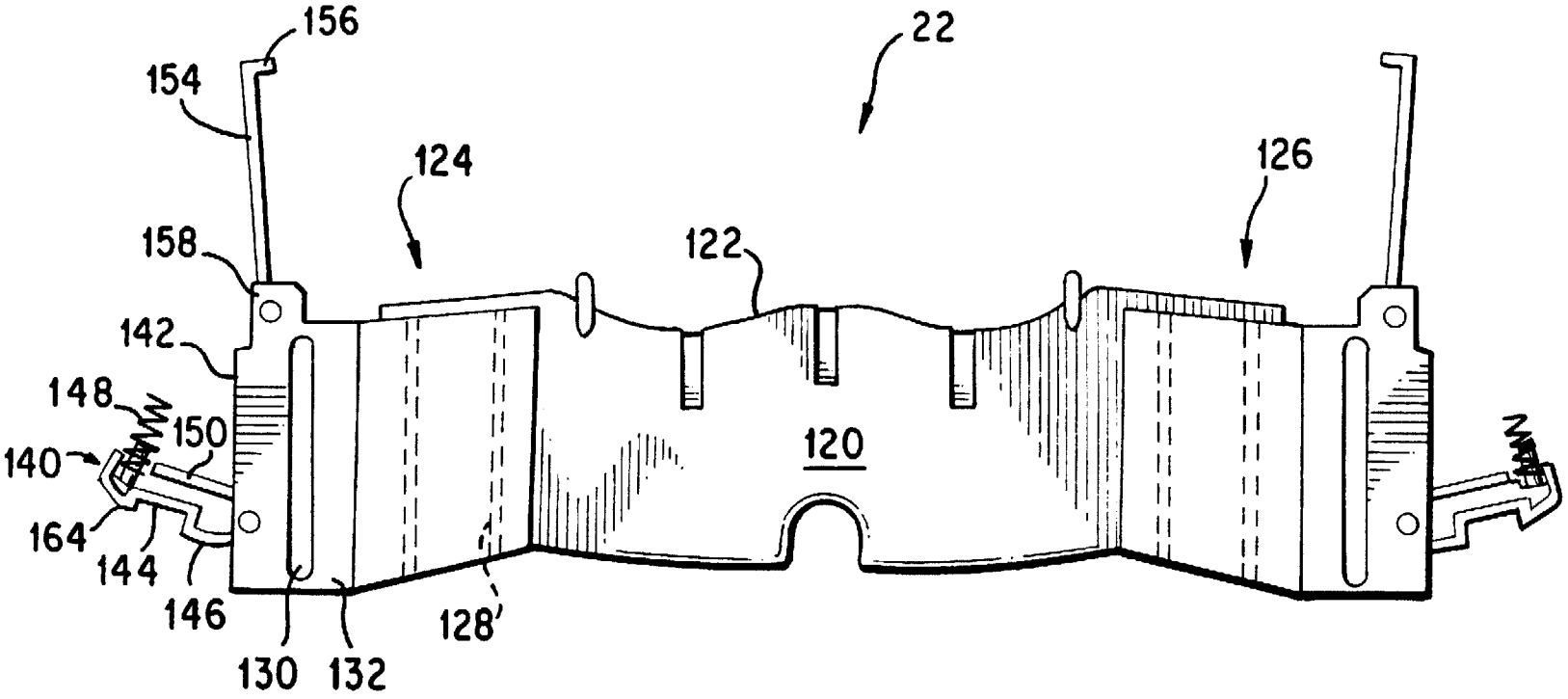
FIG. 6 is a top plan view of the trigger section of the toy gun of FIG. 1.
Figure 7:
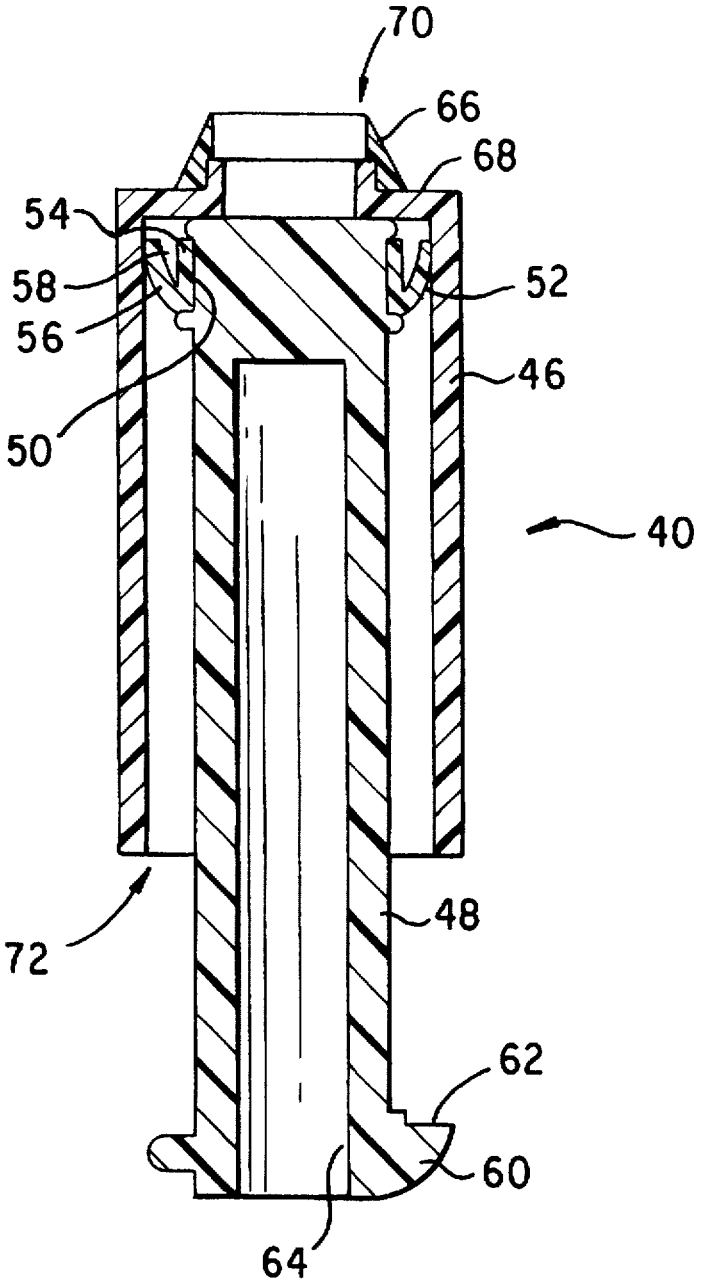
FIG. 7 is a cross-sectional view of a piston of the toy gun of FIG. 1.

The details of the toy gun are illustrated in further detail in FIGS. 2–7. FIG. 2 is a top cross-section view of the lower half of the toy gun 10 illustrating the elements of the cylindrical housings 16 and 18 and the handle and trigger section 20. The trigger 22 is illustrated in phantom (i.e., in dotted lines) in FIG. 2 to better illustrate how the trigger 22 interacts with the mechanisms inside the cylindrical housings 16 and 18 to cause the barrels 12 and 14 to fire. The trigger 22 is fully illustrated in FIG. 6, and one of the barrels 12 is illustrated in FIGS. 3–5. FIG. 7 illustrates a piston assembly 40. Since both cylindrical housings 16 and 18 are preferably identical in configuration and construction, only one cylindrical housing 16 shall be described in detail hereinbelow.

The cylindrical housing 16 includes a piston assembly 40 and a spring-loaded mechanism 42. The spring-loaded mechanism 42 functions to normally bias the trigger 22 forwardly to a non-firing position. The spring-loaded bias of the spring-loaded mechanism 42 is overcome by pressing the trigger 22 to a firing position. The piston assembly 40 produces air pressure and delivers the air pressure to the barrel 12 to fire the foam darts 24.

Referring to FIG. 7, the piston assembly 40 has a cylinder 46 which houses a piston rod 48. Rod 48 has an annular groove 50 provided at its front end for retaining an annular plastic ring 52. The ring 52 is preferably made from a soft flexible PVC plastic or similar material. The ring 52 has an inner annular wall 54 which is held against the groove 50, and a flared outer annular wall 56 extending upwardly from the bottom of the inner wall 54. An annular space 58 is defined between the inner wall 54 and the outer wall 56 for creating a vacuum to produce air pressure. The rod 48 further includes a hooked extension 60 which extends outwardly at its rear end. Hooked extension 60 has a flat surface 62 which is adapted to engage a latch member of the trigger 22 in the manner described hereinbelow. A bore 64 is provided at the rear end of rod 48. The cylinder 46 of the piston assembly 40 has an annular front wall 66 extending from an annular shoulder 68 to define an opening 70. The piston rod 48 extends through the open rear end 72 of the cylinder 46 and is reciprocated inside the cylinder 46 to create the air pressure that is used to fire the foam darts 24 from the barrel 12.

Referring now to FIG. 2, the piston assembly 40 is positioned along the outer side 74 of the housing 16. A piston support shaft 76 supports a spring 78 which is adapted to be retained inside the bore 64 of piston rod 48. The spring 78 is wrapped around the piston support shaft 76. The piston support shaft 76 is connected at its rear end to a support block 80 that is securely attached to a raised support well 82 that is integral with and extends from the bottom half of the cylindrical wall 84 of the housing 16. The piston rod 48 rides along, or is supported by, raised walls 86 and 88 extending from both the upper and lower halves of the cylindrical wall 84 of the housing 16 to form a set of rails. A stop member 90 is provided at the rear end of one of the raised walls 86 to define the rearward limit for motion by the hooked extension 60. The cylinder 46 of the piston assembly 40 is disposed inside a chamber defined by the cylindrical wall 84, the outer side 74, and an inner wall 92 extending from both the upper and lower halves of the cylindrical wall 84. The annular wall 66 of the cylinder 46 fits into an opening 93 in the front wall 94 of the housing 16. The spring 78 biases the piston rod 48 against the front wall 94 of the cylinder 46 when the piston rod 48 is in its normal non-firing position.

The spring-loaded mechanism 42 is positioned adjacent the inner side 98 of the housing 16, and includes a trigger support shaft 100 supporting a spring 102 which is adapted to be retained inside a bore 128 of the trigger 22 (as described below). The spring 102 is wrapped around the trigger support shaft 100. The trigger support shaft 100 is connected at its rear end to a support block 104 that is securely attached to a raised support well 106 that is integral with and extends from the bottom half of the cylindrical wall 84 of the housing 16.

Those skilled in the art will appreciate that the springs 78 and 102 can be in the form of coiled springs, or resilient elongated strips of material, or other similar mechanisms.

Referring now to FIG. 6, the trigger 22 has a grip bar 120 with a front edge 122 that has a wavy configuration for allowing a user to comfortably wrap the user's fingers thereabout. The front edge 122 has two concave sections **122*a* and 122*b* separated by a convex section 122*c*. Left and right sections 124 and 126 extend from both sides of the grip bar 120. Since the left and right sections 124 and 126 are identical, only the left section 124 will be described in greater detail. Also, the trigger 22, including the grip bar 120 and its left and right sections 124 and 126**, are provided in two identical pieces, an upper piece and a lower piece, that are attached together by using glue, rivets, fasteners, screws, pin-and-slot engagements, or other conventional attachment methods.

The upper piece of the trigger 22 is illustrated in FIG. 6. The left section 124 has a bore 128 (shown in phantom) for receiving the spring 102 of the spring-loaded mechanism 42. The bore 128 is formed by attaching the upper piece 132 and the lower piece (not shown) together. Ridges 130 are provided on the surface of both the upper and lower pieces of the left section 124. A latch member 140 is pivotally attached to an outer side edge 142 of the left section 124. The latch member 140 has a slot 144 cut out from its outer side edge 146, and a spring 148 extending from its inner side edge 150. A portion of the latch member 140 is preferably adapted to be fitted between the upper piece 132 and the lower piece, as illustrated in phantom in FIG. 2. In addition, a leg 154 having a hooked end 156 is pivotally attached to the outer front corner 158 of the left section 124. The pivotal attachments of the latch member 140 and the leg 154 may be accomplished by inserting a pin through the upper piece 132, the latch member 140 or leg 154, and the lower piece at the desired location, and securing the pin thereat, although those skilled in the art will appreciate that alternative mechanisms can be used as well.

Referring now to FIG. 2, the trigger 22 is positioned in the toy gun 10 in the following manner. The grip bar 120 is disposed in the handle and trigger section 20 between the upper and lower halves of the toy gun 10, and between the cylindrical housings 16 and 18. The spring 102 and a portion of its trigger support shaft 100 in each housing 16 and 18 are inserted inside the bore 128 of the left and right sections 124 and 126 of the trigger 22. The springs 102 bias the trigger 22 towards the front of the toy gun 10. The ridges 130 on each surface of the trigger 22 are retained for slidable movement between rails 160 and 162 extending from the upper and lower halves of the cylindrical wall 84 of the housings 16 and 18. The hooked extension 60 of each piston rod 48 is seated inside the slot 144 of a latch member 140, with the flat surface 62 abutting the front edge 164 of the slot 144. The spring 148 of the latch member 140 biases the latch member 140 against the piston rod 48 to ensure a close or tight interaction between the trigger 22 and the piston assembly 40. The hooked end 156 of each leg 154 is adapted to fit inside one of a plurality of scalloped regions 178 of a barrel 12 or 14, as described below.

The barrels 12 and 14 are identical, so only one barrel 12 will be described in detail. Referring to FIGS. 3–5, the barrel 12 includes a circular support plate 170 having a plurality of tubes 172 extending from a front surface of the plate 170 and spaced-apart about the circumference of the plate 170. A channel 174 extends from the plate 170 through each tube 172. A cylindrical stem 176 extends from a rear surface of the plate 170 and is provided with a plurality of scalloped regions 178. Each scalloped region 178 has a straight edge 180 connected to a curved or ramped edge 182. A barrel shaft 184 is fitted inside and attached to the stem 176. A plurality of protrusions 186 are provided along the annular outer surface of the barrel shaft 184. Each protrusion 186 has a rear edge 188 that is longer than a front edge 190, with an angled top edge 192 connecting the front edge 190 and the rear edge 188. Each protrusion 186 is preferably positioned on the annular outer surface of the barrel shaft 184 so that it is within the confines of, but below, a scalloped region 178 such that a narrow space 191 is defined between the top 189 of the long rear edge 188 and the ramped edge 182. A flanged extension 194 and a connecting shaft 195 define an annular groove 196 between the extension 194 and the bottom surface 198 of the barrel shaft 184.

The barrel 12 further includes a barrel cover 200 which fits over the front surface of the support plate 170 such that the tubes 172 pass through openings 202 that are spaced-apart about the circumference of the cover 200. A plurality of wall members 204 separate the openings 202, and are configured such that the space 206 between adjacent wall members 204 is substantially circular, and therefore adapted to receive a foam dart 24. Each foam dart 24 has a bore (not shown) into which each tube 172 is inserted. Although the toy gun 10 is illustrated as employing foam darts or arrows 24 for its ammunition, those skilled in the art will appreciate that other forms of ammunition that are made of a soft and safe material, such as foam bullets, can be employed without departing from the scope of the present invention. The cover 200 can be attached to the support plate 170 using any conventional attachment mechanism, such as but not limited to screws 208 (see FIG. 5), glue, rivets, and fasteners.

Referring now to FIGS. 2–5, the stem 176 of the barrel 12 is positioned inside an opening 110 in the front wall 94 of the housing 16, and the groove 196 is positioned inside opposing U-shaped support members 220 which extend from the cylindrical wall 84 of the upper and lower halves of the housing 16. Thus, the support members 220 are held in the groove 196 between the extension 194 and the bottom surface 198 of the shaft 184, and their U-shaped configurations define an aperture inside which the connecting shaft 195 is supported for rotation. The hooked end 156 of the leg 154 is positioned inside one of the scalloped regions 178. The barrel 12 is positioned such that the opening 70 of the piston assembly 40 is aligned with one of the channels 174. The barrel 14 is fitted inside housing 18 in the same manner.

The operation of the toy gun 10 will now be described. When the trigger 22 is pressed by the user, the trigger 22 overcomes the natural bias of the spring 102 and compresses the spring 102. The hooked extension 60, whose flat surface 62 abuts the front edge 164 of the slot 144 of latch member 140, is pulled rearwardly by the latch member 140 to a firing position, causing the piston rod 48 to overcome the natural bias of the spring 78. At this time, the hooked end 156 of the leg 154 is pulled rearwardly along the straight edge 180 of the scalloped region 178 in which it is positioned. The hooked end 156 then slides down the angled edge 192 of the protrusion 186 aligned within the confines of that scalloped region, causing the barrel shaft 184 to rotate, which in turn causes the barrel 12 to rotate.

When the trigger 22 is released, the springs 78 and 102 bias the piston rod 48 and trigger 22, respectively, forwardly towards their normal non-firing positions. This creates air pressure inside the cylinder 46 of the piston assembly 40, which is delivered via the channel 174 through the barrel 12 to fire the foam dart 24 positioned on that particular tube 172.

At this time, the hooked end 156 of the leg 152 similarly moves forward and slips through the narrow space 191 into the adjacent scalloped region 178 along its ramped edge 182. The ramped edge 182 guides the hooked end 156 to position it adjacent the straight edge 180 of that scalloped region 178. The sliding of the hooked end 156 along the ramped edge 182 further causes the barrel 12 to rotate so as to align the adjacent channel 174 with the opening 70 of the piston assembly 40. The long rear edge 188 of the adjacent protrusion 186 combines with the configuration of the hooked end 156 to prevent the hooked end 156 from sliding back into the previous scalloped region 178, since the top 189 of the long rear edge 188 will catch the hooked end 156 to prevent it from sliding back into the previous scalloped region 178. The toy gun 10 is now ready to fire the adjacent foam dart 24. The foam darts 24 in barrel 14 are fired in the same manner.

Thus, a "rapid-fire" action is created at the barrel 12 by the sliding rearward motion of the hooked end 156 along the straight edge 180 and the angled edge 192, followed by the forward sliding motion along ramped edge 182 of the adjacent scalloped region 178. This allows the foam darts 24 from the barrel 12 to be fired in rapid succession.

The toy gun 10 according to the present invention is configured to allow the user to fire foam darts 24 from one barrel 12 or 14 only, or to fire foam darts 24 from both barrels 12 and 14 simultaneously. If the user applies a greater force on one side of the trigger 22, the barrel 12 or 14 on that side of the trigger 22 will fire and the other barrel 14 or 12 will not fire. If the user applies a consistent force on the entire trigger 22, then both barrels 12 and 14 will fire. According to the present invention, this control of both barrels 12 and 14 is accomplished by using only one trigger mechanism. In particular, pressing on the concave section **122*a*, or applying a greater force to concave section 122*a* than to concave section 122*b*, will cause the barrel 12 to fire without causing the other barrel 14 to fire. Similarly, pressing on the concave section 122***b*, or applying a greater force to concave section 122*b* than to concave section 122*a*, will cause the barrel 14 to fire without causing the other barrel 12 to fire. For simultaneous firing of both barrels 12 and 14, both concave sections 122*a* and 122*b* must be pressed.

In this regard, the length of the trigger 22 can be varied to achieve different firing options. For example, if the length of the trigger 22 is very small, then pressing the trigger 22 will cause both barrels 12 and 14 to simultaneously fire since the force applied to both sides of the trigger 22 are substantially the same. If the length of the trigger 22 is increased, the user has the option of pressing on the trigger 22 in a manner which will apply a greater force to one side than to the other side, as described above, so as to fire one but not both barrels. On the other hand, if the length of the trigger 22 is further increased, the user will need to use both hands to grip both concave regions 122*a* and 122*b* of the trigger 22 to cause the two barrels 12 and 14 to fire simultaneously. Thus, the trigger 22 in one embodiment of the present invention is preferably provided with a length that will allow the user to selectively apply a greater force to one side thereof to fire one barrel but not the other, yet allows the user to use one hand to grip and press the trigger 22 to simultaneously fire both barrels 12 and 14.

Thus, the use of one trigger mechanism in the present invention to control the various firing options of two barrels 12, 14 greatly simplifies the construction for the toy gun 10, and thereby provides a less costly toy gun which can be enjoyed by many.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A toy gun for firing at least one soft ammunition, comprising:

a handle section including a trigger, the trigger having a first end and an opposing second end;

a first barrel holding at least one ammunition;

a second barrel holding at least one ammunition;

a first housing adjacent the first end of the trigger and coupled to the first barrel, the first housing having a firing mechanism coupled to the trigger for firing the ammunition from the first barrel; and a second housing adjacent the second end of the trigger and coupled to the second barrel, the second housing having a firing mechanism coupled to the trigger for firing the ammunition from the second barrel.

2. The toy gun of claim 1, wherein the at least one ammunition at each of the first and second barrels are fired simultaneously upon actuation of the trigger.

3. The toy gun of claim 1, wherein the at least one ammunition at the first barrel is fired, and the at least one ammunition at the second barrel is not fired, upon actuation of the trigger.

4. The toy gun of claim 3, wherein the first barrel is fired by applying a greater force to the first end of the trigger than to the second end of the trigger.

5. The toy gun of claim 1, further comprising a shield connected to the first and second housings and covering the handle section.

6. The toy gun of claim 1, wherein the firing mechanism in both housings comprises a piston assembly for delivering air pressure to the respective barrel for firing the respective ammunition.

7. The toy gun of claim 6, wherein the trigger comprises a first section at the first end and coupled to the piston assembly in the first housing for actuating the piston assembly, and a second section at the second end and coupled to the piston assembly in the second housing for actuating the piston assembly.

8. The toy gun of claim 7, wherein the trigger comprises a first latch assembly at the first section for engaging the piston assembly in the first housing, and a second latch assembly at the second section for engaging the piston assembly in the second housing.

9. The toy gun of claim 7, wherein the trigger comprises a first leg at the first section for engaging the first barrel, and a second leg at the second section for engaging the second barrel.

10. The toy gun of claim 9, wherein the first barrel comprises a stem coupled to the first housing, the stem comprising a plurality of scalloped regions, wherein the first leg is received in one of the plurality of scalloped regions.

11. The toy gun of claim 10, wherein each scalloped region comprises a straight edge coupled to a ramped edge.

12. The toy gun of claim 11, wherein the first barrel comprises:

a barrel shaft received inside the stem, the barrel shaft comprising a plurality of protrusions, each protrusion positioned within the confines of and below a scalloped region, each protrusion comprising an angled edge; and wherein the first leg slides rearwardly along the straight edge of one scalloped region and the angled edge of a protrusion to rotate the first barrel.

13. The toy gun of claim 12, wherein the first leg slides forwardly along the ramped edge of an adjacent scalloped region to further rotate the first barrel.

14. The toy gun of claim 7, wherein the first section of the trigger includes a ridge, and wherein the first housing includes a pair of raised walls forming a rail for receiving the ridge for slidable movement between the raised walls.

15. The toy gun of claim 8, wherein the trigger further comprises a gripping section between the first and section sections, and wherein the trigger is actuated by pressing on the gripping section, which causes the latch assemblies to reciprocate the piston assembly to fire the ammunition.

16. The toy gun of claim 15, wherein each housing further includes means for biasing the trigger away from actuating the piston assembly in the particular housing.

17. The toy gun of claim 6, wherein each barrel comprises a plurality of tubes for holding the at least one ammunition, wherein one of the tubes is in communication with one of the piston assemblies for receiving air pressure to fire the ammunition.

18. The toy gun of claim 1, wherein the ammunition is a foam dart.

19. A toy gun for firing at least one soft ammunition, comprising:

a handle section including a trigger, the trigger having a first end and an opposing second end;

a first barrel holding at least one ammunition;

a second barrel holding at least one ammunition;

a first housing adjacent the first end of the trigger and coupled to the first barrel, the first housing having a firing mechanism coupled to the trigger for firing the ammunition from the first barrel; and a second housing adjacent the second end of the trigger and coupled to the second barrel, the second housing having a firing mechanism coupled to the trigger for firing the ammunition from the second barrel.

wherein the at least one ammunition at each of the first and second barrels are fired simultaneously by applying a substantially equal force to both the first and second ends of the trigger, and wherein the at least one ammunition at the first barrel is fired, and the at least one ammunition at the second barrel is not fired, by applying a greater force to the first end of the trigger than to the second end of the trigger.

* * * * *